US010081877B2

(12) United States Patent
Richter et al.

(10) Patent No.: US 10,081,877 B2
(45) Date of Patent: Sep. 25, 2018

(54) METHOD FOR THE ELECTROPLATING OF TIAL ALLOYS

(71) Applicant: MTU Aero Engines AG, Munich (DE)

(72) Inventors: Sebastian Richter, Roehrmoos (DE); Josef Linska, Grafing (DE)

(73) Assignee: MTU AERO ENGINES AG, Munich (DE)

( * ) Notice: Subject to any disclaimer, the term of this patent is extended or adjusted under 35 U.S.C. 154(b) by 0 days.

(21) Appl. No.: 15/193,688

(22) Filed: Jun. 27, 2016

(65) Prior Publication Data

US 2017/0016132 A1 Jan. 19, 2017

(30) Foreign Application Priority Data

Jul. 14, 2015 (DE) ..... 10 2015 213 162

(51) Int. Cl.

| | |
|---|---|
| ***C25D 5/10*** | (2006.01) |
| ***C25D 5/12*** | (2006.01) |
| ***C25D 5/34*** | (2006.01) |
| ***C25D 5/38*** | (2006.01) |
| ***C25D 5/48*** | (2006.01) |

(Continued)

(52) U.S. Cl.

CPC ..... *C25D 5/38* (2013.01); *C22C 14/00* (2013.01); *C23F 1/26* (2013.01); *C25D 3/12* (2013.01); *C25D 5/10* (2013.01); *C25D 5/44* (2013.01); *C25D 11/08* (2013.01); *C25D 11/16* (2013.01); *C25D 11/24* (2013.01); *C25D 11/26* (2013.01); *C25F 3/02* (2013.01)

(58) Field of Classification Search

CPC ... C25D 5/38; C25D 5/48; C25D 3/12; C25D 5/10; C25D 5/34; C23C 28/00; C23C 28/02

USPC ..... 205/210, 212, 219, 220, 269, 271, 170, 205/191, 192

See application file for complete search history.

(56) References Cited

U.S. PATENT DOCUMENTS 4,416,739 A * 11/1983 Turner ..... C25D 5/38 205/181
4,902,388 A * 2/1990 Fornwalt ..... C23F 1/26 205/212

(Continued)

FOREIGN PATENT DOCUMENTS

DE 3710950 A1 * 10/1988 ..... C03C 15/00
EP 2551381 A1 1/2013

(Continued)

OTHER PUBLICATIONS

Dini et al., "Plating on Titanium and Zirconium," Industrial Applications of Titanium and Zirconium: Third Conference, STP32517S, R. Webster and C. Young, Ed., ASTM International, West Conshohocken, PA (no month, 1984), pp. 113-123.*

(Continued)

*Primary Examiner* — Edna Wong
(74) *Attorney, Agent, or Firm* — Barlow, Josephs & Holmes, Ltd.

(57) ABSTRACT

The present invention relates to a method for the coating of a surface of a TiAl alloy, in which at least one layer is electroplated on the surface of the TiAl alloy, wherein the surface of the TiAl alloy is subjected to an at least two-step surface treatment for the formation of a roughened surface, this treatment comprising at least one electrochemical processing and at least one electroless chemical processing.

11 Claims, 3 Drawing Sheets

(51) Int. Cl.

| | |
|---|---|
| ***C23C 28/00*** | (2006.01) |
| ***C23C 28/02*** | (2006.01) |
| ***C25D 5/44*** | (2006.01) |
| ***C25D 11/08*** | (2006.01) |
| ***C25D 11/16*** | (2006.01) |
| ***C25D 11/24*** | (2006.01) |
| ***C25D 11/26*** | (2006.01) |
| ***C22C 14/00*** | (2006.01) |
| ***C23F 1/26*** | (2006.01) |
| ***C25D 3/12*** | (2006.01) |
| ***C25F 3/02*** | (2006.01) |

(56) References Cited

U.S. PATENT DOCUMENTS

| | | | | |
|---|---|---|---|---|
| 4,938,850 | A * | 7/1990 | Rothschild | C25D 5/38 205/191 |
| 5,413,871 | A | 5/1995 | Nelson et al. | |
| 5,783,315 | A | 7/1998 | Schaeffer et al. | |
| 6,670,049 | B1 | 12/2003 | Schaeffer et al. | |
| 6,884,542 | B1 * | 4/2005 | Cheiky | C23F 1/38 429/176 |
| 2006/0032757 | A1 | 2/2006 | Brevnov et al. | |
| 2008/0085364 | A1 * | 4/2008 | Nomura | A61K 9/1682 427/243 |
| 2009/0218232 | A1 * | 9/2009 | Catalan-Asenjo | C23F 1/26 205/212 |

FOREIGN PATENT DOCUMENTS

| | | | | |
|---|---|---|---|---|
| GB | 2222179 | A | 2/1990 | |
| PL | 211775 | B1 * | 6/2012 | C25F 3/02 |
| PL | 211775 | B1 * | 6/2012 | C23F 3/02 |
| WO | 9622842 | | 8/1996 | |

OTHER PUBLICATIONS

Khataee et al., "New Titanium-Aluminum-X Alloys for Aerospace Applications," J. Mater. Eng. (no month, 1998), vol. 10, pp. 37-44.*

Khataee et al., "New Titanium-Aluminum-X Alloys for Aerospace Applications," J. Mater. Eng. (no month, 1988), vol. 10, pp. 37-44.*

Kobayashi et al., "Electroless Plating on Titanium," Jitsumu Hyomen Gijutsu (no month, 1988), vol. 35, No. 6, pp. 312-218. Abstract only. (Year: 1988).*

* cited by examiner

METHOD FOR THE ELECTROPLATING OF TIAL ALLOYS

BACKGROUND OF THE INVENTION

Field of the Invention

The invention relates to a method for the coating of surfaces of TiAl alloys, in which at least one layer is electroplated on the surface.

Prior Art

In turbomachines such as stationary gas turbines or aircraft engines, in order to increase the efficiency of the turbomachines, TiAl alloys are increasingly used, which make possible a more efficient operation of the turbomachine with simultaneously high strength due to their low specific gravity. Of course, prevailing in turbomachines are ambient conditions that require the introduction of additional protective layers, such as layers for protection against erosion, layers for protection against oxidation, heat insulating layers, and the like.

Frequently, an electroplated metal layer is provided between the component surface and the coating as a base layer or intermediate layer, in order to introduce these types of protective layers.

Similar to the case of titanium alloys and aluminum alloys, which very rapidly form oxide layers due to the affinity of their principal alloy components, titanium and aluminum, for oxygen, TiAl alloys also frequently very rapidly form an oxide layer on the surface due to the principal components, titanium and aluminum, and this makes difficult or even impossible an electroplating of a metal layer.

However, in order to make possible an electroplating of a metal layer on a surface containing titanium and/or aluminum, it is already known to roughen the surface in order to facilitate or to make possible the electroplating by means of the formation of projecting sharp points on the surface. Of course, the known methods employing a mechanical roughening or a chemical etching of the surface are not satisfactory, since either the methods are expensive or they lead to unsatisfactory results.

In the case of mechanical surface roughening, unwanted deformations and damage of the surface region can occur, and other methods, such as chemical methods, frequently do not supply the necessary adhesive strength or roughness of the surface for the subsequent electroplating.

SUMMARY OF THE INVENTION

Structure of the Invention

It is thus the object of the present invention to provide a method for the coating of surfaces of TiAl alloys, in which an electroplating of a metal layer is made possible on the surface of a component that is composed of a TiAl alloy, this electroplated coating having a sufficient adhesive strength. Simultaneously, the method shall be easy to carry out and reliable.

Technical Solution

This object is solved by a method for coating a surface of a TiAl alloy in accordance with the present invention, as described in detail below.

A TiAl alloy is understood to be a material that has titanium and aluminum as the principal components, thus as components with the highest fractions in the alloy, wherein either titanium or aluminum can represent the major component in the alloy. In particular, the latter involves a TiAl alloy that forms intermetallic phases, such as, for example, $\alpha_2$-$Ti_3Al$ and/or $\gamma$-TiAl. Such a TiAl alloy can contain a plurality of different components that are present, however, to a lesser extent than titanium and/or aluminum with respect to their concentration. The present invention can be employed correspondingly in a large range of different TiAl alloy compositions, since the effectiveness of the present invention is provided by the principal components, titanium and aluminum, and the structural components formed therefrom, even when a plurality of various alloy components are present in smaller concentrations, especially if each additional chemical element in the alloy is present in a concentration that is smaller than or equal to 10 at. %, in particular smaller than or equal to 5 at. %, preferably smaller than or equal to 3 at. %, while aluminum and titanium form the remainder.

In particular, the present invention can be used in the case of so-called TNM alloys, which designate a TiAl alloy that contains, as alloy components, niobium and/or molybdenum, particularly in fractions of 0 to 3 at. % for molybdenum and 0 to 5 at. % for niobium.

According to the invention, a surface that is formed from a TiAl alloy is coated. This means that the entire component that is to be coated, or parts thereof, can be formed from a TiAl alloy. But particularly, only a surface region to be coated also can be formed from a TiAl alloy.

According to the invention, the surface of the TiAl alloy is subjected to an at least two-step surface treatment for the formation of a roughened surface, wherein at least one step contains an electrochemical processing and at least the second step contains an electroless chemical processing.

Electrochemical processing is understood here as the processing of the surface in the presence of a chemically active substance, such as an electrolyte, with simultaneous application of an electrical voltage (potential difference), in which the material to be processed is anodically oxidized and is thus dissolved. In the case of an electroless chemical processing, only a chemically active substance is present and no electrical potential is applied.

A particularly good roughening of the surface for the subsequent electroplating can be produced by means of the two-step surface treatment having different steps, which makes possible a good adhesive strength of the coating. In particular, surfaces of a TiAl alloy with an average roughness or an average roughness depth on the order of magnitude of 1 to 20 μm, particularly 5 to 15 μm, can be produced with the two-step surface treatment.

Preferably, in the case of the two-step surface treatment, the electrochemical processing can form the first step of the treatment, whereas an electroless chemical processing takes place in the second step. A particularly effective surface treatment for obtaining a roughness that makes possible a particularly good adhesive strength of electroplated layers is provided by a combination of the electrochemical surface processing and a subsequent electroless chemical processing.

An acetic acid-hydrofluoric acid solution, which can have, in particular, a composition, in which the concentration by weight of the acetic acid amounts to 800 to 900 g/L and the concentration by weight of the hydrofluoric acid amounts to 100-200 g/L, can be used for the electrochemical processing by anodic etching.

The electroless chemical processing can be produced by active etching in a fluoroboric acid-sodium tetrafluoroborate solution.

Between the processing steps of electrochemical processing and electroless chemical processing and/or prior to the electrochemical processing, a cleaning step can be conducted with compressed air cleaning and/or cleaning with sprayed water by means of a water gun, which preferably can be followed by a drying step.

In addition to the two-step surface treatment with an electrochemical processing and an electroless chemical processing, prior to the two-step surface treatment, a chemical etching of the TiAl surface, that is the surface of a TiAl alloy, additionally can be conducted with nitric acid containing ammonium bifluoride. The composition of the ammonium bifluoride-containing nitric acid can be such that the concentration by weight of the nitric acid lies in the range of 300 to 400 g/L, whereas the ammonium bifluoride can be present in a weight concentration of 50 to 80 g/L.

Prior to the two-step surface treatment or prior to the chemical etching of the surface of a TiAl alloy, a chemical cleaning step can be conducted, which can be carried out with an alkaline cleaning solution.

After the two-step surface treatment, a chemical activation of the surface of the TiAl alloy can be conducted with a sulfuric acid solution.

Between and/or after the individual processing steps, i.e., the chemical etching with an ammonium bifluoride-containing nitric acid, the two-step surface treatment with the electrochemical processing on the one hand, and the electroless chemical processing, as well as the chemical activation of the surface, a rinsing of the TiAl surface with demineralized water can be carried out each time.

The electroplated layer, which can be deposited after the corresponding pretreatment of the TiAl surface, can be a nickel or cobalt layer, which can be deposited with a layer thickness of at least 1 μm, preferably at least 5 μm, or, in particular, at least 10 μm.

After the deposition of the electroplated layer, at least one second layer can be deposited, which can be introduced by different methods, such as, for example, again by electroplating, by PVD (physical vapor deposition), CVD (chemical vapor deposition), thermal spraying, welding, soldering, and the like.

BRIEF DESCRIPTION OF THE DRAWING FIGURES

DESCRIPTION OF THE INVENTION

Further advantages, characteristics and features of the present invention will be made clear in the following detailed description of an example of embodiment, the invention not being limited to this embodiment example.

In the exemplary embodiment, a component made of a TNM alloy is subjected to a coating, which contains 43 to 45 at. % aluminum, 0.5 to 3 at. % molybdenum, 0 to 4.0 at. % niobium, a sum total of 0 to 5 at. % vanadium, chromium, manganese and iron, a sum total of 0 to 0.5 at. % hafnium and zirconium, 0.1 to 1 at. % carbon, and 0.05 to 0.2 at. % boron, as well as 0 to 1 at. % silicon. The component that is formed completely from the TiAl material in the present case, but which can also only have a surface region made of the TiAl material, is first subjected to a chemical cleaning with an alkaline cleaning solution of the name TURCO 5948 DPM (protected tradename of the Henkel Co.).

After the chemical cleaning, a chemical etching is carried out in a nitric acid containing ammonium bifluoride, with 350 g/L of nitric acid and 60 g/L of ammonium bifluoride. After the etching with the nitric acid solution containing ammonium bifluoride, the TiAl-containing surface is sprayed with compressed air or a water jet from an air/water gun for the removal of the etching slurry, and subsequently dried.

After this, an anodic etching is carried out in concentrated acetic acid/hydrofluoric acid solution with a composition of 850 g/L of acetic acid and 150 g/L of hydrofluoric acid. Also after the anodic etching, the surface is cleaned by spraying with compressed air and/or a water jet from an air/water gun.

Subsequently, the chemically active etching is conducted with a fluoroboric acid-sodium tetrafluoroborate solution.

After this processing step, the surface is rinsed with demineralized water. The rinsing with demineralized water can be provided in addition to the other cleaning steps described, both after the chemical cleaning as well as after the chemical etching and the anodic etching.

To conclude the pretreatment of the TiAl-containing surface for the subsequent electroplating, a chemical activation of the surface is carried out in a sulfuric acid solution.

After rinsing with demineralized water, the thus-pretreated TiAl component can be subjected to electroplating with a layer of nickel and/or cobalt, which has a layer thickness of at least 5 μm.

Subsequently, the most diverse coatings, such as thermal insulation layers, oxidation protection layers, erosion protection layers, layers for protection against wear, layers for weight correction, can be deposited by the most varied methods.

The individual method steps need not be carried out directly one after the other, but after a cleaning step and a drying step, the method can be interrupted and then continued again later after a pause by the next processing step.

Figure 1:
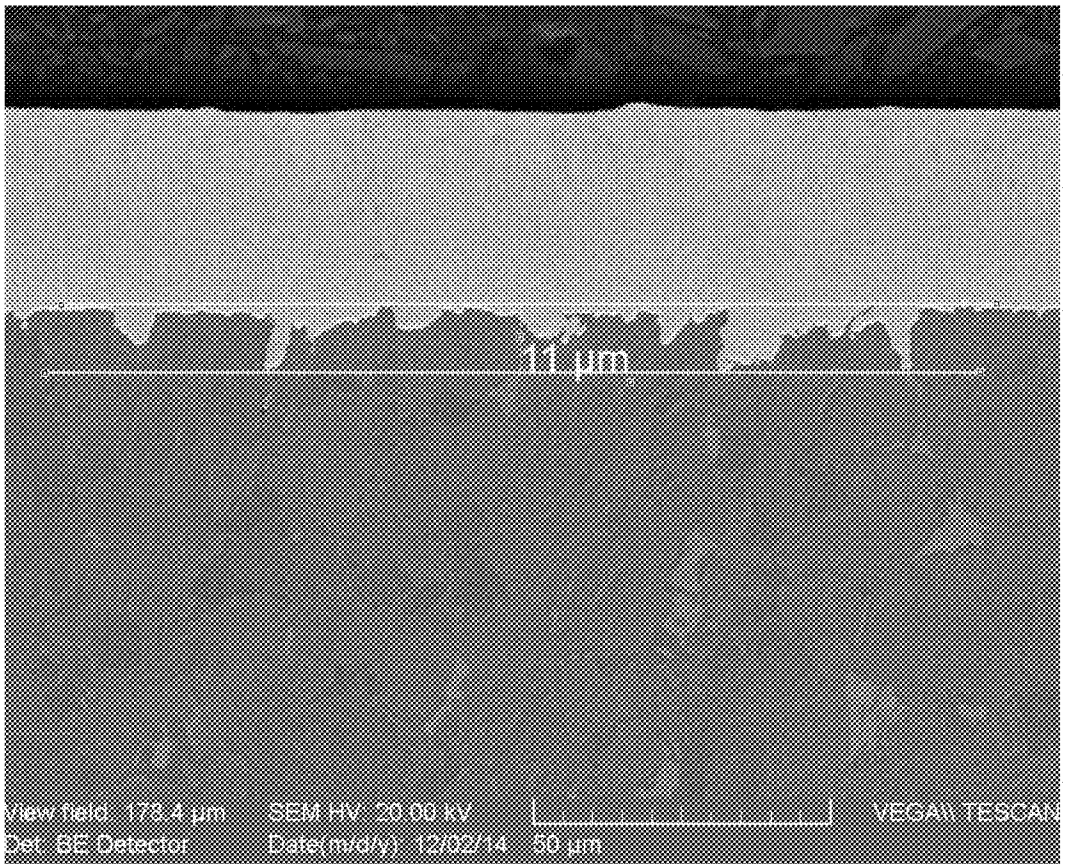
FIG. 1 is a scanning electron micrograph of a cross section through an electroplated coating on a TNM alloy.

FIG. 1 shows a metallographic cross section in a scanning electron micrograph, wherein the TNM base material can be seen in the lower region of the image (dark gray), and the electroplated coating can be seen in the upper part (light gray). It can be clearly recognized that the interface has a rough structure that makes possible the electroplating and brings about a good adhesive strength of the deposited layer.

Figure 2:
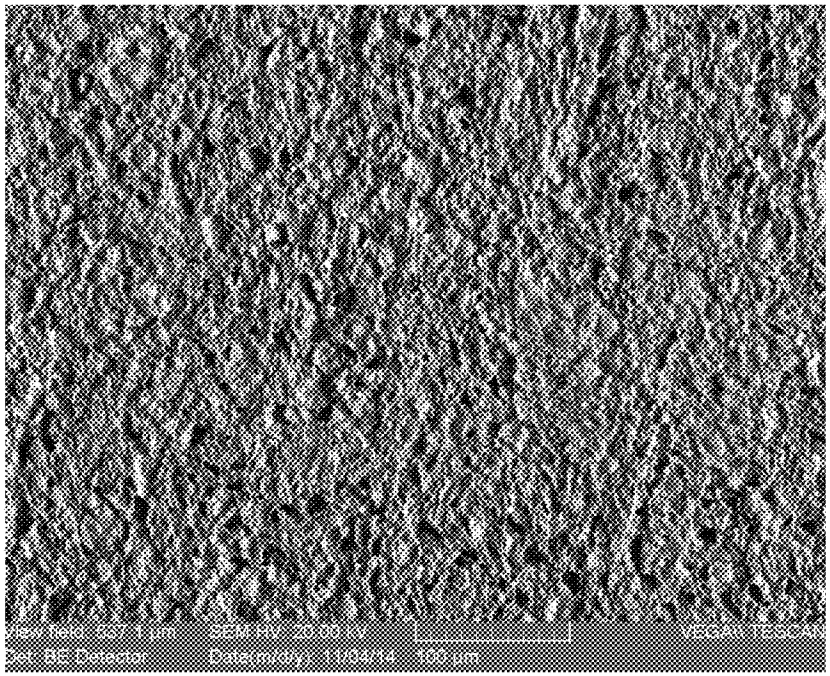
FIG. 2 is a scanning electron micrograph of the surface of the TNM alloy prior to the electroplating; and in FIG. 3 is the surface of FIG. 2, which was taken in a larger magnification and with the secondary electron detector of the scanning electron microscope.
Figure 3:
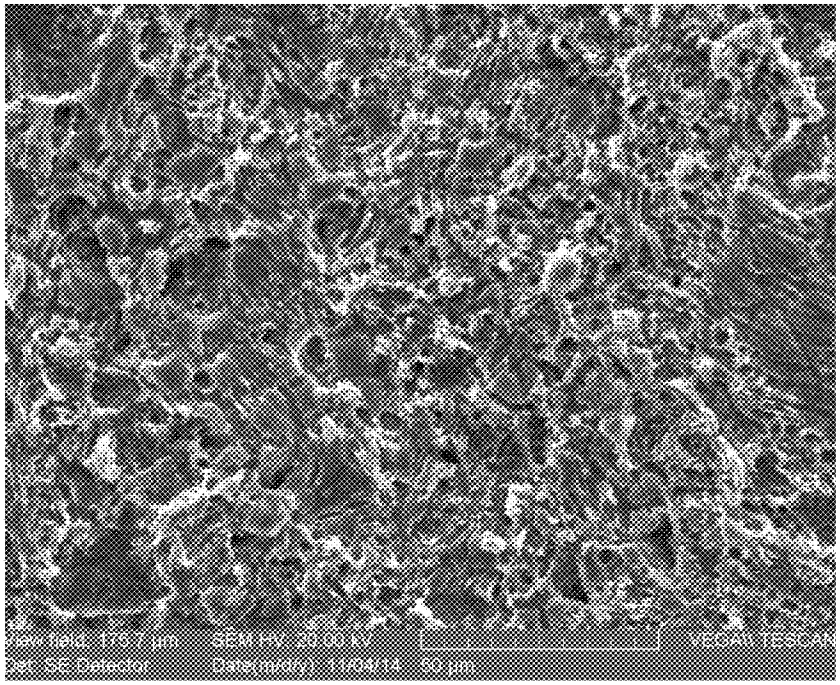

FIGS. 2 and 3 show scanning electron micrographs of the surface of the TNM component prior to the deposition of the electroplated layer. Here also it can be recognized that the surface has a pronounced structuring that makes possible the subsequent electroplating of the layer and improves the adhesive strength of the electroplated layer.

Although the present invention has been described clearly on the basis of the example of embodiment, it is obvious to a person skilled in the art that the invention is not limited to this example of embodiment, but rather that many deviations are possible in the sense that individual features can be omitted or other combinations of features can be realized. The present disclosure includes all combinations of the individual features presented.

What is claimed is:

1. A method for coating a surface of a TiAl alloy, comprising the steps of:

providing a TiAl alloy having a surface;

roughening the surface of the TiAl alloy in a two-step surface treatment, including:

applying an electrochemical process to the surface; and treating the surface with an electroless chemical process after the electrochemical process;

wherein the surface of the TiAl alloy is sufficiently roughened after the electrochemical process and electroless chemical process without mechanical roughening of the surface of the TiAl alloy;

chemically activating the surface of the TiAl alloy after roughening the surface of the TiAl alloy in the two-step surface treatment; and electroplating at least one layer on the surface of the TiAl alloy after the step of chemically activating the surface of the TiAl alloy, wherein the electrochemical processing is conducted by anodic etching in an acetic acid-hydrofluoric acid solution, wherein concentrations by weight of 800 to 900 g/L of acetic acid and 100 to 200 g/L of hydrofluoric acid are selected for the composition of the acetic acid-hydrofluoric acid solution.

2. The method according to claim 1, wherein the step of electroless chemical processing is etching the surface of the TiAl alloy with a fluoroboric acid-sodium tetrafluoroborate solution.

3. The method according to claim 1, further comprising the steps of:

between the electrochemical processing step and the electroless chemical processing step cleaning the surface of the TiAl alloy with compressed air and/or a water jet; and drying the surface of the TiAl alloy after cleaning the surface.

4. The method according to claim 1, further comprising the step of:

prior to the two-step surface treatment, chemically etching of the surface of the TiAl alloy with a nitric acid solution containing ammonium bifluoride, wherein, weight concentrations of 300 to 400 g/L of nitric acid and 50 to 80 g/L of ammonium bifluoride are selected for the nitric acid solution.

5. The method according to claim 4, further comprising the step of:

prior to the step of chemical etching of the surface of the TiAl alloy with the nitric acid solution containing ammonium bifluoride, chemically cleaning the surface with an alkaline cleaning solution.

6. The method according to claim 1, wherein the step of chemically activating the surface of the TiAl alloy is chemically activating of the surface with a sulfuric acid solution.

7. The method according to claim 1, further comprising the step of:

rinsing of the surface with demineralized water between and/or after each of the individual processing steps.

8. The method according to claim 1, wherein a nickel or cobalt layer is deposited as the electroplated layer.

9. The method according to claim 1, further comprising the step of:

depositing at least one second layer on the electroplated layer.

10. The method according to claim 9, wherein the at least one second layer is deposited by a method that is selected from the group consisting of electroplating, physical vapor deposition, chemical vapor deposition, thermal spraying, welding, and soldering.

11. The method according to claim 1, wherein the TiAl alloy further comprises niobium and/or molybdenum as additional components, wherein the niobium content is in the range of 0 to 5 at. % and/or the molybdenum content lies in the range of 0 to 3 at. % and the Al content lies in the range of 40 to 45 at. %, with the remainder being Ti and other additional alloy components.

* * * * *